United States Patent [19]

Ayoub et al.

[11] Patent Number: 4,677,849

[45] Date of Patent: Jul. 7, 1987

[54] HYDROCARBON WELL TEST METHOD

[75] Inventors: Joseph Ayoub, Lafayette, La.; Dominique Bourdet, Vaux-le-Pénil, France

[73] Assignee: Schlumberger Technology Corporation, Houston, Tex.

[21] Appl. No.: 767,216

[22] Filed: Aug. 19, 1985

[30] Foreign Application Priority Data

Aug. 29, 1984 [FR] France ..... 84 13359

[51] Int. Cl.[4] ..... E21B 49/00

[52] U.S. Cl. ..... 73/155

[58] Field of Search ..... 73/155, 151, 152; 166/250

[56] References Cited

U.S. PATENT DOCUMENTS

| | | | |
|---|---|---|---|
| 3,321,965 | 5/1967 | Johnson et al. | 73/155 |
| 3,550,445 | 12/1970 | Kiel | 73/155 |
| 3,636,762 | 1/1972 | Kuo et al. | 73/155 |
| 4,328,705 | 5/1982 | Gringarten | 73/155 |
| 4,597,290 | 7/1986 | Bourdet et al. | 73/155 |
| 4,607,524 | 8/1986 | Gringarten | 73/152 |

OTHER PUBLICATIONS

World Oil, vol. 196, No. 6, pp. 95–106, May 1983, D. Bourdet, etc.

*Primary Examiner*—Stewart J. Levy
*Assistant Examiner*—Scott M. Oldham

[57] ABSTRACT

The invention relates to a well test method for determining the physical characteristics of a system made up of a well and a subsurface formation containing a fluid such as a hydrocarbon. A change in the flow rate of said fluid is produced for a short period (duration $t_P$ of the order of a few minutes) so as to obtain a flow pulse resembling a Dirac pulse; the variations $\Delta P$ of the down-hole fluid pressure is measured during said short period and then during the subsequent period of return to the initial state of the well-formation system, and the experimental pressure curve thus obtained is compared with the curves of a double network of type curves representing, as a function of a common parameter, the pressure $P_D$ and its derivative $P'_D$ with respect to time, by matching the branch of the experimental curve corresponding to the short period with a curve $P_D$ and the branch of this curve corresponding to the subsequent period with the curve $P'_D$ of the same parameter.

3 Claims, 5 Drawing Figures

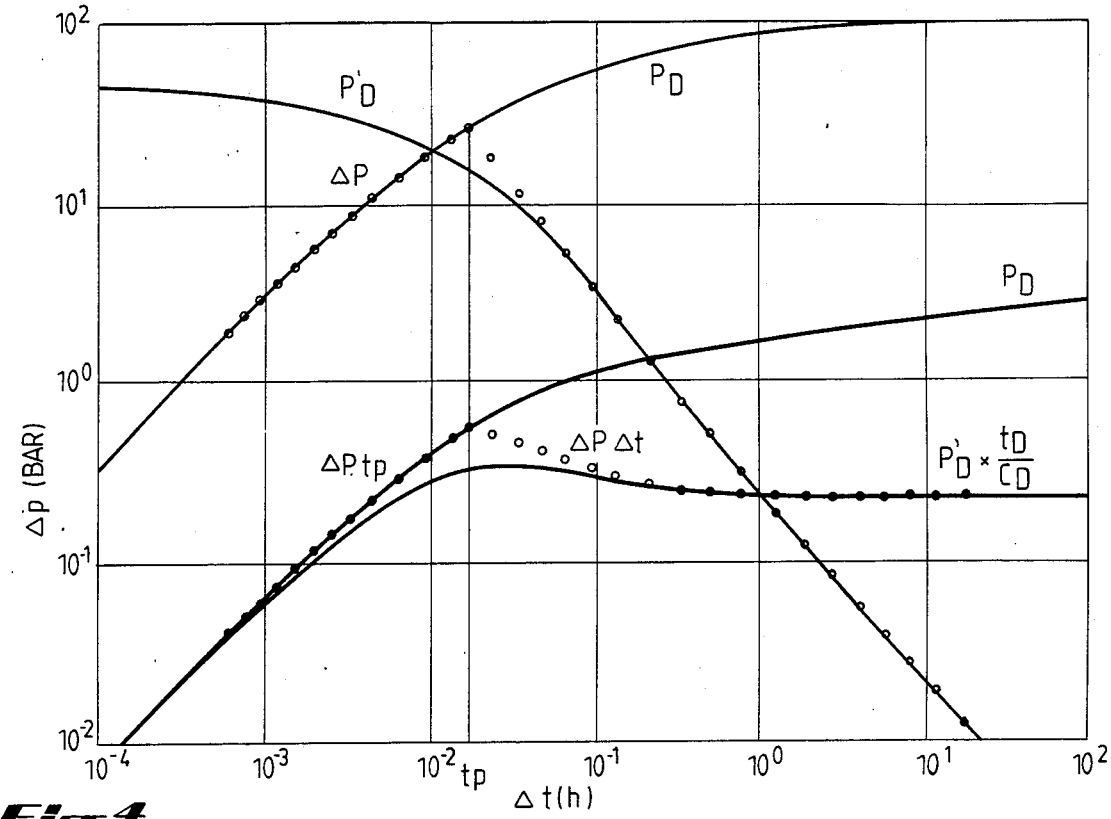
Fig. 4
Fig. 5
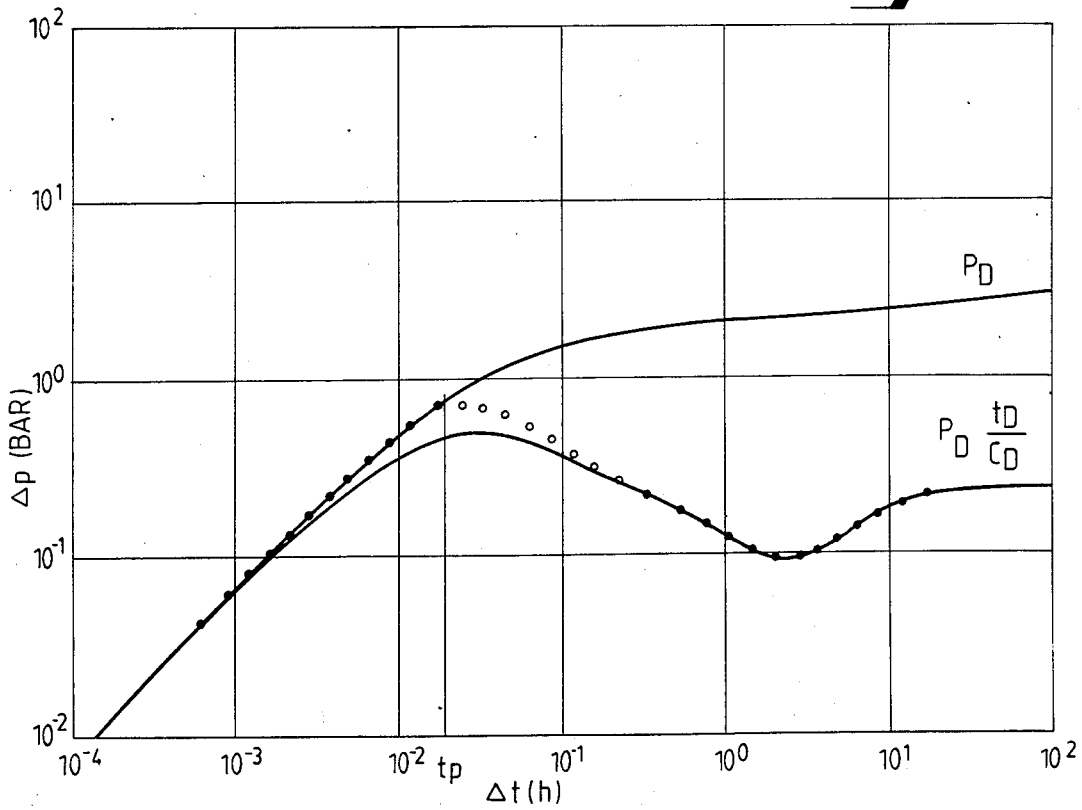

HYDROCARBON WELL TEST METHOD

FIELD OF THE INVENTION

This invention relates to the testing of hydrocarbon wells making it possible to determine the physical characteristics of the system consisting of a well and of a subsurface formation (also called reservoir) producing a fluid, hydrocarbons for example, through the well.

BACKGROUND OF THE INVENTION

More precisely, the invention relates to a method whereby the flow of fluid produced by the well is modified by closing or opening a valve located on the surface or in the well. The resulting pressure variations are measured or recorded down-hole or on the surface as a function of the time elapsing since the beginning of the tests, i.e. since the flow modification. The characteristics of the well-subsurface formation system can be deduced from these experimental data. They are analyzed by comparing the response of the subsurface formation to a change in the flow of fluid produced, with the behavior of theoretical models having well-defined characteristics and subjected to the same flow change as the investigated formation. Usually, the pressure variations as a function of time characterize the behavior of the well-formation system, and the removal of fluids at constant flow, by opening an initially closed valve in the well, is the test condition which is applied to the formation and to the theoretical model. When their behaviors are identical, it is assumed that the investigated system and theoretical model are identical from the quantitative as well as the qualitative viewpoints. In other words, these reservoirs are assumed to have the same physical characteristics.

The characteristics obtained from this comparison depend on the theoretical model: the more complicated the model, the greater the number of characteristics which can be determined. The basic model is represented by a homogeneous formation with impermeable upper and lower limits and with an infinite radial extension. The flow in the formation is then radial, directed toward the well. However, the theoretical model most currently used is more complicated. It comprises the characteristics of the basic model to which are added internal conditions such as the skin effect and the wellbore storage effect. The skin effect is defined by a coefficient S which characterizes the damage or the stimulation of the part of the formation adjacent to the well. The wellbore storage effect is characterized by a coefficient C which results from the difference in the flow of fluid produced by the well between the subsurface formation and the wellhead when a valve located at the wellhead is either closed or opened. The coefficient C is usually expressed in barrels per psi, a barrel being equal to 0.16 $m^3$ and a psi to 0.069 bar.

The behavior of a theoretical model is represented conveniently by a network of typical curves which represent the down-hole fluid pressure variations as a function of time. These curves are usually plotted in cartesian coordinates and in a logarithmic scale, the dimensionless pressure being plotted on the ordinate and the dimensionless time on the abscissa. In addition, each curve is characterized by one or more dimensionless numbers, each representing a characteristic (or a combination of characteristics) of the theoretical system formed by a well and a reservoir. A dimensionless parameter is defined by the real parameter (pressure for example) multiplied by an expression which includes certain characteristics of the well-reservoir system so as to make the dimensionless parameter independent of these characteristics. Thus, the coefficient S characterizes only the skin effect but is independent of the other characteristics of the reservoir and of the experimental conditions such as flow rate, viscosity of fluid, permeability of formation, etc. When the theoretical model and the investigated well-formation system correspond, the experimental curve and one of the type curves represented with the same scales of coordinates have the same form but are offset in relation to each other. The offsets along the two axes, on the ordinate for pressure and on the abscissa for time, are proportional to values of characteristics of the well-reservoir system which can thus be determined.

Qualitative information on the subsurface formation, such as the presence of a fracture for example, is obtained by identifying the different flows on the network in logarithmic scale representing the experimental data. Knowing that a particular characteristic of the well-reservoir system, a vertical fracture for example, is characterized by particular flow conditions, all the different flows appearing in the graph of the experimental data are identified to select the appropriate well-reservoir system model. The characteristics of the formation are obtained by selecting a typical curve having the same form as the experimental curve and determining the offset of the axes of the coordinates of the experimental curve in relation to the theoretical curve.

Several networks of typical curves correspond to a given theoretical model. This depends on the dimensionless parameters chosen for representing the axes of coordinates, as well as on one or more indexes. An index is nothing other than an additional parameter (or combination of parameters) chosen to represent the curves, in addition to the dimensionless parameters of the axes of coordinates.

A comparison of the different methods used is given in the article entitled "A Comparison Between Different Skin and Wellbore Storage Type Curves for Early-Time Transient Analysis" by A. C. Gringarten & al., published by the "Society of Petroleum Engineers of AIME", (No. SPE 8205). The U.S. Pat. No. 4,328,705 also describes a method according to which the type curves are represented using the dimensionless pressure $P_D$ for the access of ordinates and the ratio $t_D/C_D$ for the access of abscissas, $t_D$ being the dimensionless time and $C_D$ the dimensionless coefficient characterizing the wellbore storage effect. The drawback of the method described in that patent is that the type curves have shapes varying relatively slowly with respect to each other. This results in some uncertainty in the choice of type curves corresponding to the experimental curve. It is also noted that, for a complete analysis, one is required to use not only a graph in logarithmic scale representing all the experimental data, but also specialized graphs in semi-logarithmic scale for example, to analyze only part of the data but in a more precise manner.

A procedure has already been tried whereby the mathematical derivative of the dimensionless pressure $P'_D$ is used instead of the dimensionless pressure $P_D$. According to Bourdet et al, U.S. Pat. No. 4,597,290, issued July 1, 1986 and the article "A New Set of Type Curves Simplifies Well Test Analysis" published in the May 1983 issue of World Oil, the curve of the derivative $\Delta P'$ of the experimentally measured pressure is plotted and this curve is matched with a type curve of a typical network $P'_D(t_D/C_D)$.

Such a method gives satisfactory results but requires pressure measurements in the well over a relatively long period.

It is the object of the present invention to provide a new method making it possible to shorten the experimental time in the field. This method makes advantageous use of the derivative $P'_D$ of the dimensionless pressure. It is moreover based upon Green's functions (see Carslaw H. S. and Jaeger J. C., "Conduction of Heat in Solids", Second Edition, Oxford University Press, 1959) which relate to the analysis of pressure transients. Briefly, Green's functions provide the pressure variations with respect to time created by a source (or a well—in the fluid mechanics sense) of instantaneous action and unit intensity (Dirac pulse, i.e. a pulse with a duration of $\Delta t$ and an amplitude of $1/\Delta t$, the surface of the pulse being equal to 1, and $\Delta t$ tending towards zero). Mathematically, Green's functions correspond to the derivatives with respect to time of the type curves $P_D$ used as a theoretical model. The result is that if a formation is subjected to an instantaneous action of unit intensity, the curve of subsequent pressure variations may be matched with a suitable curve $P'_D$.

In practice, it is not possible to subject the formation to an instantaneous action of unit intensity, as the injection or production of fluid corresponding to this action must necessarily last a finite time. However, the experiment demonstrated that the action could extend over a few minutes without any detriment to the quality of the results.

BRIEF SUMMARY OF THE INVENTION

In other words, it is the object of the invention to provide a well test method for determining the physical characteristics of a system consisting of a well and a subsurface formation containing a fluid and communicating with said well, this formation, homogeneous or heterogeneous, exhibiting the skin effect and/or the wellbore storage effect. This method involves a change in the flow rate of the fluid and the measurement of a characteristic parameter of the pressure P of the fluid at successive time intervals $\Delta t$. According to the invention, said change of flow is produced in a short period so as to obtain a flow pulse resembling a Dirac pulse, the amplitude of this pulse being sufficiently high to enable the measurement of said parameter characteristic of the pressure P of the fluid at said successive time intervals $\Delta t$.

The change in flow rate consists of a short period during which the well is producing, injected or closed. The variations in the down-hole pressure P of the fluid are measured during said short period and then during the subsequent period of return tp the initial state of the well-formation system, and one compares the experimental pressure curve thus obtained with the curves of a double network of type curves representing, as a function of a common parameter, the pressure P and its derivative P' with respect to time, by matching the branch of the experimental curve corresponding to the short period with one of the type curves P and the branch of this curve corresponding to the subsequent period with the type curve P' of the same parameter.

Thus, the experimental results obtained by the method according to the invention are advantageously analyzed by matching the pressure curve measured experimentally with a network of type curves. This analysis is distinguished from prior-art methods by the fact that this matching takes place with pressure P type curves only for part of the experimental curve, and for the other part of the experimental curve with derivative pressure P' type curves. In addition, this analysis is performed without requiring the derivation of experimental data. This results from the very particular conditions of short pressure pulses applied to the well-formation system, which is one of the essential characteristics of the present invention. It should be noted that, if it were posssible practically to subject the formation-well system to a flow variation of very short duration, a few seconds for example, the characteristics of the formation would be determined only using the derivative type curves $P'_D$.

In a preferred embodiment of the methcd thus defined, the type curves of the double network are plotted in logarithmic coordinates as a function of $t_D/C_D$, $t_D$ representing the dimensionless time and $C_D$ the dimensionless coefficient of the wellbore storage effect, the parameter being the quantity $C_De^{2S}$, where S is a skin effect coefficient, and this double network comprises:

a network of curves representing the evolution of the dimensionless parameter $P_D$, and a network of curves representing the evolution of the product of $t_D/C_D$ multiplied by the derivative $P'_D$ of the pressure $P_D$ in relation to $t_D/C_D$, and the experimental pressure curve is also plotted in logarithmic coordinates, after having undergone the following operations:

the pressure values of the branch corresponding to the short period are multiplied by the duration $t_p$ of this period, and the pressure values of the branch corresponding to the subsequent period are multiplied by the time $\Delta t$ elapsing since the beginning of the short period, the amplitude of the vertical and horizontal shifts necessary for the matching as well as the value determined for the parameter then making it possible to calculate the characteristics of the well-formation system, based upon the measured value of the total amount of fluid produced or injected during the short period or, for a well producing (or receiving) a fluid and whose production (or injection) is stopped for a short instant, based upon the amount of fluid which would have been produced or injected if this stopping of production or injection had not taken place.

Advantageously, the experimental curve is first translated vertically so that its second branch corresponding to the subsequent period is matched with a type curve $P'_{D\,(tD/CD)}$, then horizontally to match its first branch with the corresponding curve $P_D$.

The method according to the invention offers new means of testing hydrocarbon wells. It has general application possibilities. The method can be used for example to test hydrocarbon wells in production, during short periods compared with prior-art methods. Well production is interrupted only for a short instant, a few seconds, whereas in conventional methods the well closure time varies on the average from 10 hours to a few days. The result is that, by applying the present invention, the financial loss due to the interruption of production is negligible. The method is also particularly well suited to the testing of new wells when the experimentation time must be short (from 1 to 20 hours) or when a flow-out onto the surface is not possible or should be avoided. This method makes it possible to obtain quickly the same information provided by conventional tests. It can be used for conducting fast tests on superposed layers of a subsurface formation and thereby obtain the vertical profile of the permeability of the formation.

BRIEF DESCRIPTION OF THE DRAWINGS

Other characteristics and advantages of the invention will appear more clearly from the following description of nonlimitative embodiments given with reference to the appended drawings in which:

FIGS. 4 and 5 illustrate the embodiment of part of the method according to the invention, respectively in the case of a homogeneous formation and a heterogeneous formation.

DETAILED DESCRIPTION OF THE PREFERRED EMBODIMENTS

According to the method of the invention, the subsurface formation is subjected to a flow pulse and the resulting pressure variations are recorded. This flow pulse can be created either by putting into production (or injecting) a well previously at rest, or by interrupting the production or injection of a well. The flow pulse must be sufficiently short so as to approach ideally a Dirac pulse. It is however seen that, in practice, this flow pulse must have a sufficient amplitude so that the resulting pressure variations are measurable by means of pressure sondes currently used in the petroleum industry.

This method makes advantageous use of the fact that this type of disturbance (flow pulse) generates pressure variations which are compared directly with the $P'_D$ type curves already mentioned, without having to carry out the derivative of the experimental data.

Figure 1:
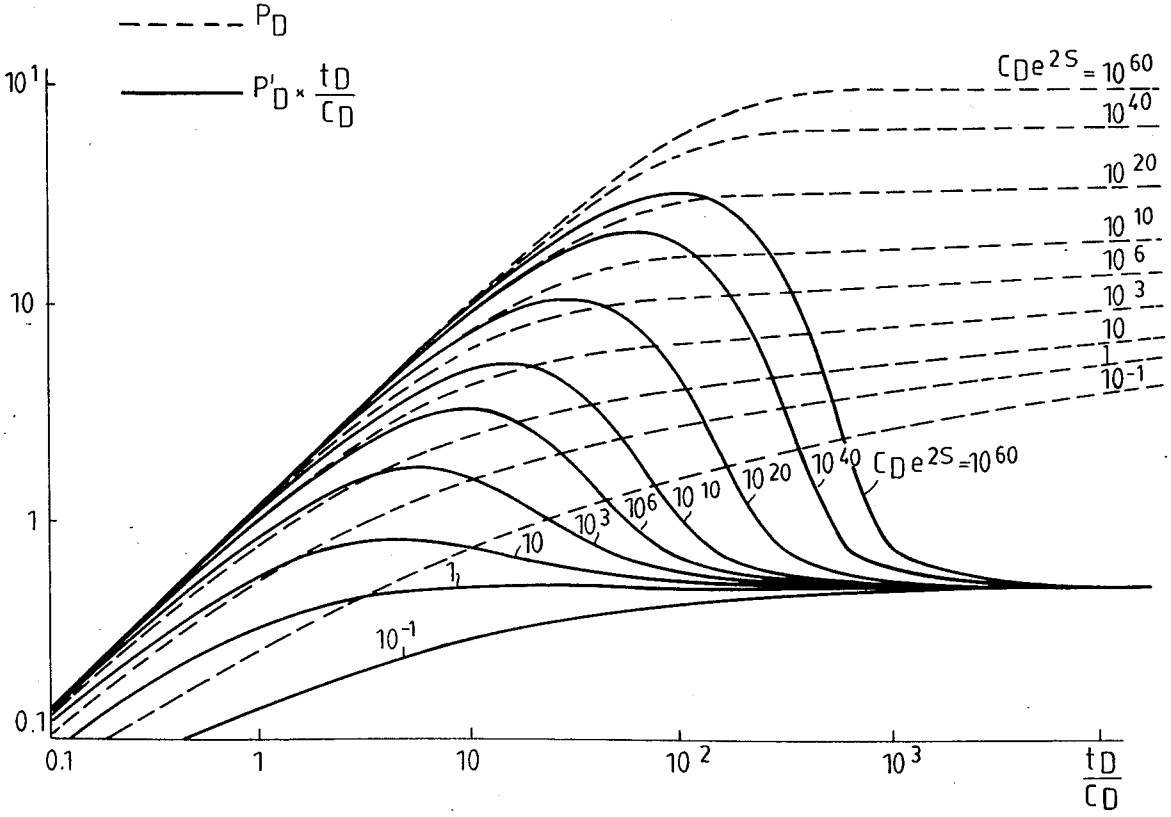
Fig. 1 (PRIOR ART)
FIG. 1 represents a network of kncwn type curves serving as a theoretical model.

The analysis of experimental data obtained by the method of the invention involves known networks of type curves, for example those shown in FIG. 1 (see FIG. 7 in the above-mentioned article of World Oil, or FIG. 5 of the French patent filing No. 83/07 075). This is a double network. It includes a first network of curves (broken-line plot) representing the variations in the dimensionless pressure $P_D$ of the fluid as a function of the ratio $t_D/C_D$ in which $t_D$ is the dimensionless time and $C_D$ is a dimensionless coefficient relating to the wellbore storage effect. The second network of curves (unbroken line plot) represents the product of $t_D/C_D$ multiplied by the derivative $P'_D$ of the pressure $P_D$ in relation to $t_D/C_D$. The curves of these two networks depend on a common parameter $C_De^{2S}$ combining two physical characteristics of the well-reservoir system, namely $C_D$ defined above, and S which is a coefficient relative to the skin effect in the well. They are plotted in logarithmic coordinates, the dimensionless quantity $t_DC_D$ being plotted on the abscissa.

The value of the dimensionless pressure $P_D$ is given by the following equation using the system of units currently used in the oil industry and called oil field units on Page 185 of the book entitled "Advances in Well Test Analysis" published by the "Society of Petroleum Engineers of AIME"—1977:

$$P_D=(kh/141.2qB\mu)\ \Delta P \qquad (1)$$

in which k represents the permeability of the subsurface formation, h is the thickness of the formation, ΔP is the measured pressure variation, q is the flow of fluid on the surface, B is the formation volume factor relating to fluid expansion between the reservoir and surface, and μis the viscosity of the fluid.

The value of the ratio $t_D/C_D$ in the same system of units as for the preceding equations is given by:

$$t_D/C_D=0.000295\ (kh/\mu)\ (\Delta t/C)$$

in which C is the wellbore storage effect.

The network of FIG. 1 characterizes the behavior of a model of a homogeneous reservoir and a well exhibiting the skin effect and the wellbore storage effect.

The curves $P'_D.(t_D/C_D)$ which are used here have a more accentuated relief than the $P_D$ curves, which favors the accuracy of the result obtained.

According to an embodiment of the method, the tested well is put into production or injected for a time $t_p$ as short as possible.

Figure 2:
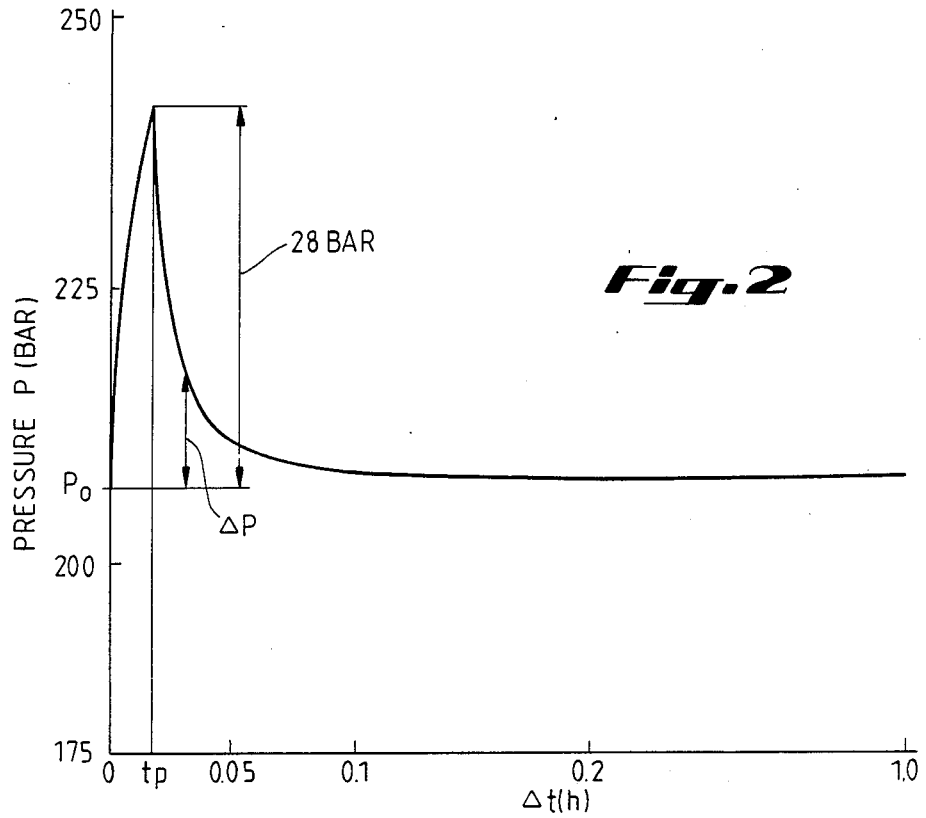
FIG. 2 represents an experimental pressure curve obtained on a well-subsurface formation system in accordance with the method of the invention, the well being previously at rest.

However, this time must, firstly, be sufficiently short so that the test principle based upon the Dirac pulse is applicable and, secondly, long enough so that the amount of fluid injected or produced is sufficient to produce a measurable pressure variation. In general, this time is of the order of few minutes and rarely exceeds 10 minutes. The down-hole pressure of the fluid is measured during this production phase and then after the flow of the well is stopped. A curve (FIG. 2) representing the values of the pressure P measured as a function of time Δt is plotted. In the present example, the pressure P increases from its initial value of 207 bars to the maximum value of 235 bars during the time $t_p$=0.16 h, or 1 min, then decreases rapidly towards its initial value Po. The pressure variations ΔP are calculated with respect to the initial value Po.

Figure 3:
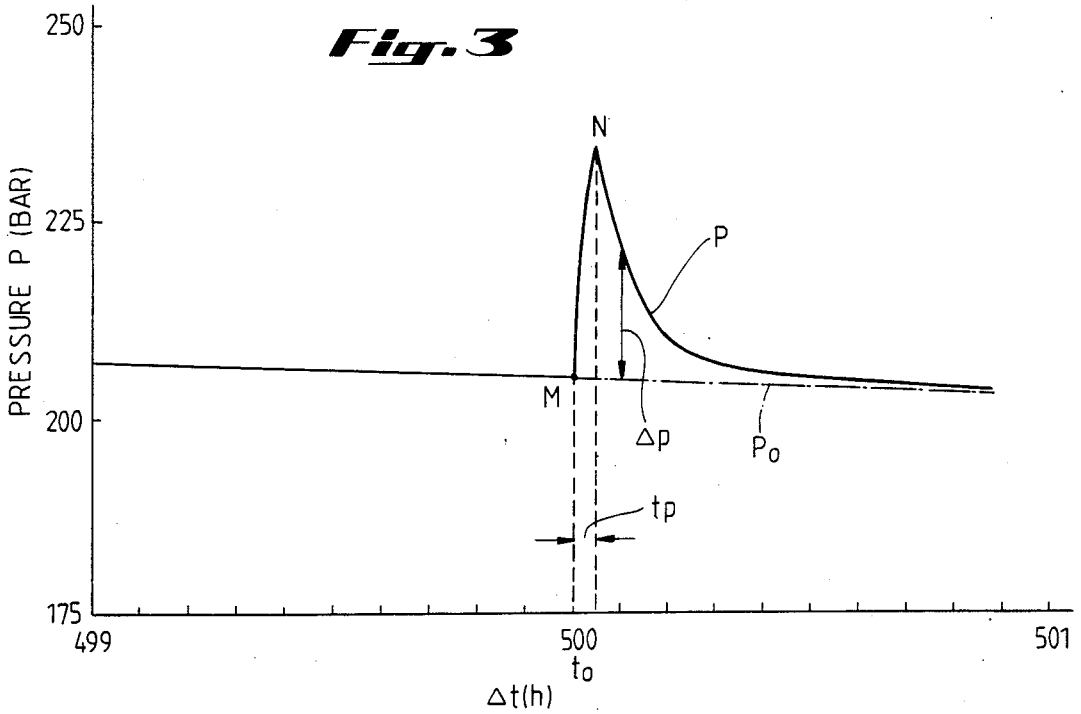
FIG. 3 represents an experimental pressure curve obtained on a well-subsurface system according to the method of the invention, the well previously producing a fluid.

According to another embodiment, the injection of fluid into the formation or the production of fluid by the formation is interrupted for a short period of time making it possible to approximate the Dirac pulse. It is this latter case which is illustrated in FIG. 3 corresponding to a well which has been in production for several hundred hours. After 500 hours, the well is closed for a period $t_p$ of about 3 minutes and then opened again. During the closure of the well, the pressure rises suddenly from M to N. Upon reopening the well, the pressure P drops from N to a value which tends toward the pressure $P_o$ which would have prevailed in the well had it not been closed. This pressure $P_o$ can easily be obtained by extrapolating the pressure P just before the well is closed. The variations ΔP to be taken into account are obtained by taking the difference between the pressures P and $P_o$ at different time intervals Δt. The time intervals are counted from the instant $t_o$ the well is closed.

One then plots (FIG. 4) an experimental curve (referenced ΔP and shown by circle-points) representing the pressure variations ΔP as a function of the time intervals $\Delta t$ in logarithmic scale. This is valid for the two embodiments described earlier (FIGS. 2 and 3).

At this stage, it can be observed that it is possible to match a curve of the network $P_D$ with the part of the curve $\Delta P$ preceding the instant $t_p$, and a curve of the network $P'_D$ with the part of the curve $\Delta P$ located beyond the instant $t_p$.

However, to be able to use the double network of type curves of FIG. 1, the curve $\Delta P$ is subjected to the following transformation:

in its portion preceding the instant $t_p$, the values of $\Delta P$ are multiplied by the value of $t_p$, which is tantamount to a vertical shift of amplitude $\log.t_p$, in its portion after the instant $t_p$, the values of $\Delta P$ are multiplied by $\Delta t$, i.e. the ordinate of each point is multiplied by its abscissa.

One thus obtains a new curve $\Delta P.t_p$; $\Delta P.\Delta t$ made up of two brances which are connected at the point corresponding to the instant $t_p$. One then seeks to match the left-hand branch of this curve with a curve $P_D$ of the network of FIG. 1, and it s right-hand branch with the curve $P'_D$. $(t_D/C_D)$ corresponding to said curve $P_D$ (same parameter $C_De^{2S}$).

For this purpose, we begin by superposing the right-hand part, which is rectilinear, of the experimental curve plotted in FIG. 4 by means of points, over the rectilinear part of the type curves on the right of the graph. This is easy since this part of the curves is a line with a zero slope. We then shift the experimental curve along the time axis so as to match its left-hand part with the corresponding type curve $P_D$. In the present example, matching is obtained with type curves of parameter $C_De^{2S}=10$. The shifting of the axes of coordinates of the experimental curve with the axes of the type curves makes it possible to determine the values of the product kh and the value of the wellbore storage effect, as explained on Pages 16 and 17 of the above-mentioned French patent filing.

It is to be noted that the vertical shifting observed after said matching is cumulated with the shift $t_p$ produced earlier. The result is that, in formula (1), the flow q is multiplied by the production time $t_p$ so that here it is the total amount of fluid issuing from the well which is taken into account and must be measured.

FIG. 4 shows that the test conducted on the well can end only two hours (approximately) after it starts, which demonstrates that the new method allows fast experimentation while providing the same information on the subsurface formation as prior-art methods.

The representation of the type curves with $P_D$ and $P'_D.t_D/C_D$ on the ordinate and $t_D/C_D$ on the abscissa is utilizable not only for homogeneous subsurface formations but also non-homogeneous formations exhibiting, for example, a double porosity. FIG. 5 shows an example of an application to a formation having a double porosity. In this case, the fluid produced by the formation is contained in the matrix, i.e. in the rock making up the formation, and in the interstices or cracks contained in the matrix. We thus have a system in which the fluid contained in the matrix first flows in the cracks before going into the well. The fluid, which moves relatively rapidly out of the cracks, is replaced relatively slowly by the matrix. Owing to the more disturbed evolution which results for the experimental pressure curve in its straight part, matching takes place precisely and without ambiguity and enables a clear distinction of the homogeneous and heterogeneous behaviors.

In the case of formations with a heterogeneous behavior, the corresponding type curves are used. For example, in the case of a behavior with a double porosity, use is made of the type curves described in an article appearing in World Oil, October 1983, entitled "Interpreting Well Tests in Fractured Reservoirs" by D. Bourdet et al.

When the experimental data obtained before the time $t_P$ are not processed because none of the $P_D$ type curves corresponds to them (left-hand part of FIG. 4), it is nevertheless possible to carry out the interpretation of the tests by superposing the straight parts of the experimental and theoretical curves (right-hand part of FIG. 4), making it possible to select a theoretical curve $P'_D$ shifting the experimental curve horizontally until the experimental value at the time $t_P$ coincides with a point of the curve $P_D$ corresponding to the curve $P'_D$ selected. In this case it is considered that the branch of the experimental part on the left in FIG. 4 is reduced to a point (corresponding to the time $t_P$).

The part of the method of the invention which consists in determining the characteristics of the subsurface formation from the experimental data can of course be implemented by means of a computer which would have the type curves in memory. The experimental data would be furnished to the computer, which would transform them as indicated above (multiplication by $t_P$ or by $\Delta t$) and would automatically determine the sought characteristics. It is to be noted that computer programs are commercially available at the present time for type curve matching.

We claim:

1. A well test method for determining the physical characteristics of a system consisting of a well and of a subsurface formation a system consisting of a well and of a subsurface formation containing a fluid such as a hydrocarbon and communicating with said well, wherein the formation is homogeneous or heterogeneous and exhibits the skin effect and/or the wellbore storage effect, comprising changing the flow rate of said fluid and measuring a characteristic parameter of the pressure P of the fluid at successive time intervals $\Delta t$, the change of flow rate being carried out in a short period so as to obtain a flow pulse resembling a Dirac pulse, with the amplitude of said flow pulse being sufficiently high to allow the measurement of said characteristic parameter of the pressure P of the fluid at said successive time intervals $\Delta t$, and being characterized in that one also measures the variations in the pressure P of the fluid during said short period, then during the subsequent period of return to the initial state of the well-formation system, and one compares the experimental pressure curve thus obtained with the curves of a double network of type curves representing, as a function of a common parameter, the pressure P and its derivative P' with respect to time, by matching the branch of the experimental curve corresponding to the short period with a curve P and the branch of this curve corresponding to the subsequent period with the curve P' of the same parameter.

2. The method of claim 1, characterized in that the type of curves of the double network are plotted in logarithmic coordinates as a function of $t_D/C_D$, where $t_D$ represents the dimensionless time and $C_D$ the dimensionless coefficient of the wellbore storage effect, the parameter being the quantity $C_De^{2S}$, where S is a skin effect coefficient, and in that this double network comprises:

a network of curves representing the evolution of the dimensionless pressure $P_D$, and a network of curves representing the evolution of the product of $t_D/C_D$ multiplied by the derivative $P'_D$ of the pressure $P_D$ in relation to $t_D/C_D$, while the experimental pressure curve is also plotted in logarithmic coordinates, after having undergone the following operations:

the values of the pressure variations $\Delta P$ of the branch corresponding to the short period are multiplied by the duration $t_p$ of this period, and the values of the pressure variations $\Delta P$ of the branch corresponding to the subsequent period are multiplied by the time $\Delta t$ elapsing since the beginning of the short period, the amplitude of the vertical and horizontal shifts necessary for matching as well as the value determined for the parameter then making it possible to determine characteristics of the well-formation system, based upon the measured value of the total amount of fluid produced or injected during the short period.

3. The method of claim 2, characterized in that the experimental curve is translated vertically to match with a type curve $P'_D(t_D/C_D)$ its second branch corresponding to the subsequent period, and horizontally to matcn its first branch with the corresponding curve $P_D$.

* * * * *